United States Patent [19]

Harrison

[11] 4,138,055

[45] Feb. 6, 1979

[54] PERIODICAL HOLDER

[76] Inventor: Howard M. Harrison, 5 Teaticket Park, Teaticket, Mass. 02536

[21] Appl. No.: 829,647

[22] Filed: Sep. 1, 1977

[51] Int. Cl.[2] ..... B65D 91/00

[52] U.S. Cl. ..... 232/1 C; 248/309 R; 248/231

[58] Field of Search ..... 232/17, 1 C, 39; 248/309 R, 315, 218.4, 231, 219.1

[56] References Cited

U.S. PATENT DOCUMENTS

| | | | |
|---|---|---|---|
| 1,193,024 | 8/1916 | Kennedy | 248/315 X |
| 1,297,021 | 3/1919 | Shodron | 248/231 |
| 1,656,426 | 1/1928 | Cunningham | 232/39 |
| 2,457,274 | 12/1948 | Rifken | 248/309 R |
| 3,042,293 | 7/1962 | Miller | 232/17 |
| 3,086,674 | 4/1963 | Scheuerman | 232/1 C |
| 3,612,460 | 10/1971 | Smith | 248/231 X |

*Primary Examiner*—Francis K. Zugel

*Attorney, Agent, or Firm*—Norman S. Blodgett; Gerry A. Blodgett

[57] ABSTRACT

Periodical holder consisting of a diaphragm having cuts to divide it into a plurality of flexible fingers.

3 Claims, 6 Drawing Figures

PERIODICAL HOLDER

BACKGROUND OF THE INVENTION

In carrying out the delivery of newspapers and the like to residences, it is common practice to do so from a vehicle. It is also common practice for the newspaper publisher to provide a tube for receiving the newspaper, which tube is adapted to be attached to a post located beside the street where it is accessible from the vehicle. Such well-known rceptacles have a number of deficiencies, however, not the least of which is the fact that they are fairly expensive. They are also bulky, which means that it is difficult to mail them to a customer. Furthermore, there is a tendency for the wind to blow the newspaper out of the receptacle and also the receptacle does not adapt itself readily to variations in size of the newspaper. These and other difficulties experienced with the prior art devices have been obviated in a novel manner by the present invention.

It is, therefore, an outstanding object of the invention to provide a periodical holder which may be fabricated in substantially one piece by the injection molding process from an elastomer plastic.

Another object of this invention is the provision of a periodical holder which is simple in construction, which is inexpensive to manufacture, and which is capable of a long life of useful service with a minimum of maintenance.

A further object of the present invention is the provision of a periodical holder which is capable of operation under outdoor conditions with a minimum of deterioration due to exposure to the weather.

It is another object of the instant invention to provide a periodical holder which can be placed adjacent the highway for receiving periodicals delivered by automobile, the holder being capable of receiving and holding the journal easily from the automobile, and serving to hold the periodical tightly irrespective of size.

A still further object of the invention is the provision of a periodical holder being adapted to be attached to a post in an outdoor location from which the periodical cannot be dislodged readily by the wind.

It is a further object of the invention to provide a holder for receiving a delivered periodical such as a rolled newspaper, which holder does not require painting to maintain its pleasing appearance, in which the article can be easily inserted by the person delivering it and from which it can be easily removed by the person to whom it is delivered.

It is a still further object of the present invention to provide a holder for rolled newspapers or the like which is not subject to vandalism or damage by the insertion of firecrackers or the like, and which does not protrude from its supporting mount so as to be liable to damage by being struck by passing vehicles and the like.

With these and other objects in view, as will be apparent to those skilled in the art, the invention resides in the combination of parts set forth in the specification and covered by the claims appended hereto.

SUMMARY OF THE INVENTION

In general, the invention consists of a periodical holder having a base which is adapted to be attached to a support and a ring extending laterally from the base. A diaphragm extends across the ring, which diaphragm is formed of a flexible material and has cuts extending from a generally central point to the periphery to divide the diaphragm into a series of angular flexible fingers.

More specifically, the base ring and diaphgram are integrally formed of an elastomer plastic. The cuts originate in a circular aperture formed in the center of the diaphragm and radiate outwardly to terminate in semicircular apertures formed at the outer end of each cut adjacent the ring. The base is formed of a generally trapezoidal-shaped plate extending from the center plane of the ring outwardly thereof and is provided with two substantially-spaced apertures for insertion of bands to facilitate mounting it on a post.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
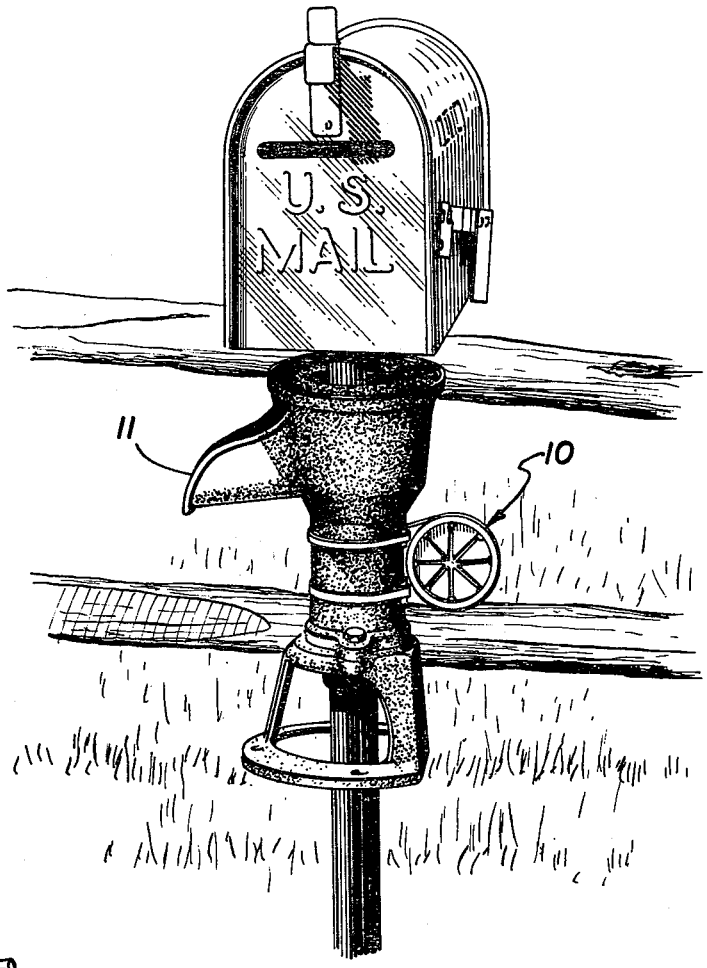
FIG. 1 is a perspective view of a periodical holder embodying the principles of the present invention.

Referring first to FIG. 1, wherein are best shown the general features of the invention, the periodical holder, indicated generally by the reference numeral 10, is shown as attached to a support 11. In the illustration the support is shown as a post at the top of which is mounted in a mail box.

Figure 2:
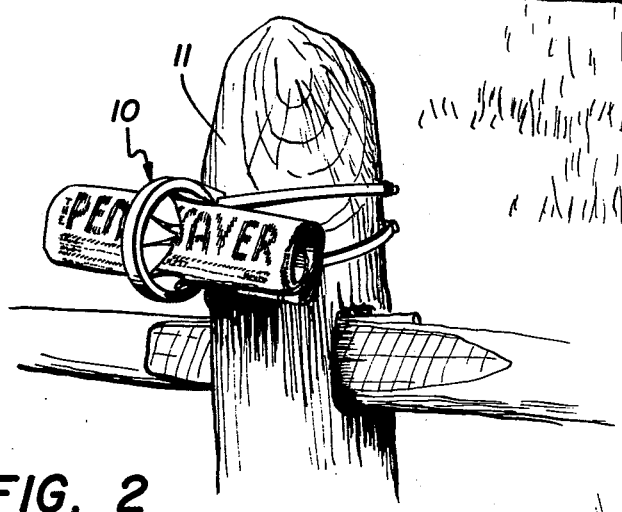
FIG. 2 is a perspective view of the holder taken from the rear and showing a periodical in place.
Figure 3:
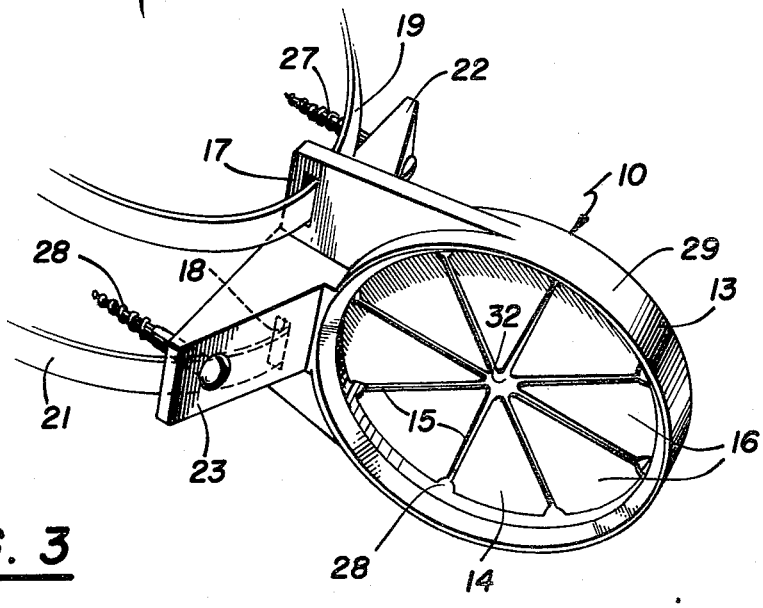
FIG. 3 is an enlarged perspective view of the holder.

In FIG. 2 the holder 10 is shown mounted on the support 11 and carrying a wrapped-up newspaper.

FIGS. 3–6 show the details of the invention. The periodical holder 10 has a base 12 which is adapted to be attached to the support. Fastened to the base is a ring 13 which extends laterally therefrom. A diaphragm 14 extends across the ring in the center plane thereof. The diaphragm is formed of flexible material and is provided with cuts 15 extending from its center to its periphery adjacent the inner surface of the ring to divide the diaphragm into a plurality of angular fingers 16.

The base 12 is provided with two-spaced apertures 17 and 18 through which are passed straps 19 and 21, respectively, adapted to extend around a post and hold the apparatus in place.

The base 12 is also provided with abutments 22 and 23 which extend in opposite directions and are provided adjacent their ends with apertures 24 and 25, respectively, which receive screws 26 and 27 for fastening the apparatus to a wooden post or the like.

As is evident in the drawings, the base 12, the ring 14, and the diaphragm 15 are integrally formed of an elastomer plastic, such as polyvinyl chloride by the injection molding process. The ring 13 is circular and is provided with an inner surface 28 and an outer surface 29. The diaphragm 14 is circular and is connected at its outer periphery 31 to the inner surface 27 of the ring. A circular aperture 32 extends through the diaphragm. Each of the cuts 15 terminates at its end in this aperture and radiates outwardly therefrom. At the outer end of each of the cuts 15 is located an aperture 33. Each of the apertures 33 is of generally semi-circular form with the arc extending away from the inner surface 28 of the ring. In the preferred embodiment, the cuts 15 divide the diaphragm into eight fingers, so that the angle subtended by two adjacent cuts is 45°.

Figure 5:
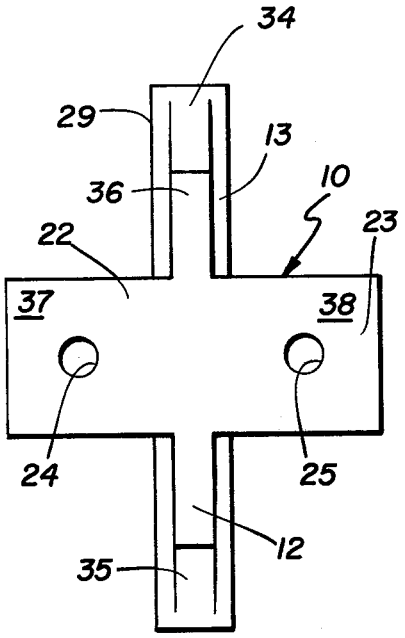
FIG. 5 is a side elevational view of the invention.
Figure 4:
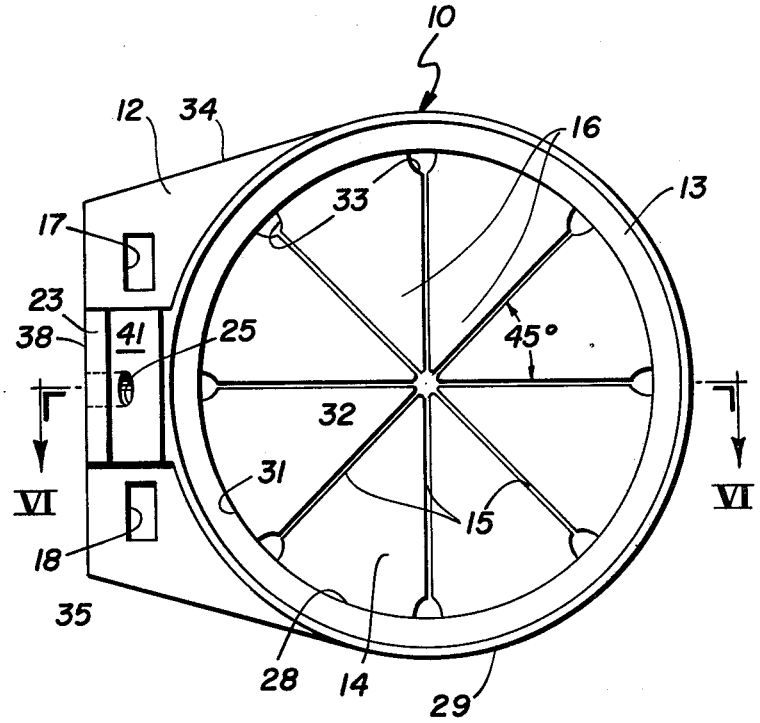
FIG. 4 is a front elevational view of the holder.
Figure 6:
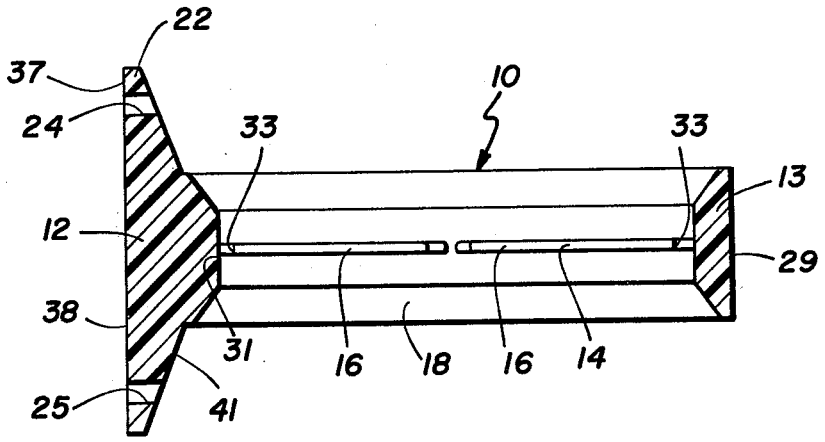
FIG. 6 is a horizontal sectional view of the holder taken on the line VI—VI of FIG. 4.

The base 12 is in the form of a flange extending from the ring 13 and is thinner than the ring, as is best shown in FIG. 5. The flange is bounded by two-opposite straight edges 34 and 35 which extend tangentially from the outer periphery or surface 29 of the ring (which surface is generally cylindrical in form). The edges 34 and 35 are joined by a third straight edge 36 which is spaced from the ring. The abutments 22 and 23 are provided with outer surfaces 37 and 38 which lie in the same plane as the said third edge 36. Each of the abutments is provided with an inner surface 39 and 41 (see FIG. 6), it extends from its outer end at an acute angle to its corresponding outer surface to its inner end at the outer surface of the ring.

The operation of the invention will now be readily understood in view of the above description. First of all, the holder 10 is usually connected to a post adjacent the street where the person delivering the newspaper or other periodical can deliver without leaving his vehicle. As shown in FIGS. 1 and 2, the bands 19 and 21 are used in conjunction with the apertures 17 and 18 in the base 12 to attach it to a post which, in this case, is the supporting post for a conventional mail box. Under some circumstances, it may be desirable to use the screws 27 and 28 through the abutments 22 and 23 to support the device on the wooden surface, such as the side of a house or some object where the use of the bands is not desirable or possible. The holder is then in position for use and, when a rolled-up newspaper has been inserted, it has the appearance shown in FIG. 2. Insertion of the periodical presses the fingers 16 out of the normal plane of the diaphagm. Normally, the subscriber to the journal would remove the journal from the side opposite the one in which the journal was inserted. The clearance provided at the inner end of the fingers by the central aperture 32 assist the fingers in bending outwardly from the central plane. Additionally, it obviates the likelihood of the inner ends of the fingers curling permanently and effecting the appearance as well as the operability of the device, which would be true, if the ends of the fingers were perfectly sharp. The provision of the apertures 33 at the outer ends of the cuts 15 serves a dual purpose. First of all, it allows the fingers to bend more easily out of the central plane of the ring. Secondly, it prevents the occurrence of localized high stresses at sharp corners due to the bending movement.

The advantages of the above invention can now be readily appreciated. Because the holder is integrally formed of an elastomer plastic, it is not subject to deterioration by the weather. It is capable of being manufactured inexpensively and there is no need to paint or otherwise maintain it. It is particularly free of susceptibility to damage, especially the damage caused by vandals. It is easily installed, it is rugged in construction, and it provides the advantage of easy accessibility by the delievery personel, so that the time spent at each stop is reduced. The nature of the base on which the ring and diaphragm are mounted allows the holder to be attached to a variety of support surfaces.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Periodical holder, comprising:

(a) a base provided with two spaced apertures adapted to receive straps for mounting on a post-like support, (b) a circular ring extending laterally from the base, the base being in the form of a flange extending from the ring and being thinner than the ring, the flange being bounded by two opposite straight edges extending tangentially from the outer periphery of the ring and being joined by a third striaght edge which is spaced from the ring, (c) abutments that extend laterally of the plane on the ring in opposite directions, each abutment being provided with an aperture adapted to receive a screw to fasten the holder to a support, and (d) a circular diaphragm connected at its outer periphery to the inner surface of the ring, the diaphragm being formed of a flexible material having a central circular aperture, a plurality of semi-circular apertures formed around the periphery of the diaphragm with their circular edges facing inwardly, and a plurality of cuts extending from the circular aperture, there being one cut to each semi-circular aperture to divide the diaphragm into a series of angular fingers, the base, ring, and diaphragm being integrally formed of an elastomer plastic.

2. Periodical holders as recited in claim 1, wherein adjacent cuts lie at an angle of 45° to divide the diaphragm into eight fingers.

3. Periodical holder as recited in claim 1, wherein the abutments are provided with outer surfaces that lie in the plane of the said third edge, and wherein each abutment is provided with an inner surface that extends from its outer end at an acute angle to its outer surface to its inner end at the outer surface of the ring.

* * * * *